US011618648B2

(12) United States Patent
Birrer

(10) Patent No.: US 11,618,648 B2
(45) Date of Patent: Apr. 4, 2023

(54) SAFETY MONITORING DEVICE FOR MONITORING SAFETY-RELATED STATES IN A PASSENGER CONVEYOR SYSTEM AND METHOD FOR OPERATING SAME

(71) Applicant: Inventio AG, Hergiswil (CH)

(72) Inventor: Eric Birrer, Buchrain (CH)

(73) Assignee: INVENTIO AG, Hergiswil (CH)

( * ) Notice: Subject to any disclaimer, the term of this patent is extended or adjusted under 35 U.S.C. 154(b) by 423 days.

(21) Appl. No.: 16/760,481

(22) PCT Filed: Oct. 5, 2018

(86) PCT No.: PCT/EP2018/077190
§ 371 (c)(1),
(2) Date: Apr. 30, 2020

(87) PCT Pub. No.: WO2019/086205
PCT Pub. Date: May 9, 2019

(65) Prior Publication Data

US 2020/0346893 A1 Nov. 5, 2020

(30) Foreign Application Priority Data

Oct. 31, 2017 (EP) ..... 17199318

(51) Int. Cl.
*B66B 5/00* (2006.01)
*B66B 9/00* (2006.01)
(Continued)

(52) U.S. Cl.
CPC ..... *B66B 5/0031* (2013.01); *B66B 1/50* (2013.01); *B66B 9/00* (2013.01); *B66B 13/22* (2013.01);
(Continued)

(58) Field of Classification Search
CPC ..... B66B 5/0031; B66B 1/50; B66B 9/00; B66B 13/22; B66B 29/00; H01H 1/00; H01H 2231/03
See application file for complete search history.

(56) References Cited

U.S. PATENT DOCUMENTS 4,977,984 A 12/1990 Arnosti et al.
5,247,139 A 9/1993 Schon et al.
(Continued)

FOREIGN PATENT DOCUMENTS

CN 102190216 A 9/2011
CN 105829231 A 8/2016
(Continued)

*Primary Examiner* — Jeffrey Donels
(74) *Attorney, Agent, or Firm* — William J. Clemens; Shumaker, Loop & Kendrick, LLP

(57) ABSTRACT

A safety monitoring device monitoring safety-related states in a passenger conveyor system has first and second double contact relays each controlled by a control voltage to switch first and second normally open contacts and a feedback contact synchronously between an open and closed relay states. First and second controllers each determine properties of the system correlated with safety-related states and in dependence generate the control voltages. The controllers and two double contact relays form first and second safety monitoring switch arrangements for monitoring first and second safety-related states and correspondingly switch first and second switching states within a safety monitoring chain of the system. The first arrangement includes the first contact of the first connected in series with the first contact of the second relay. The second arrangement includes the second contact of the first relay connected in parallel with the second contact of the second relay.

14 Claims, 3 Drawing Sheets

(51) Int. Cl.

| | |
|---|---|
| ***B66B 13/22*** | (2006.01) |
| ***B66B 29/00*** | (2006.01) |
| ***B66B 1/50*** | (2006.01) |
| ***H01H 1/00*** | (2006.01) |

(52) U.S. Cl.
CPC ..... *B66B 29/00* (2013.01); *H01H 1/00* (2013.01); *H01H 2231/03* (2013.01)

(56) References Cited

U.S. PATENT DOCUMENTS

| | | | | |
|---|---|---|---|---|
| 6,446,760 | B1 | 9/2002 | Lisi | |
| 2012/0186914 | A1* | 7/2012 | Birrer | B66B 5/0031 187/247 |
| 2016/0311653 | A1* | 10/2016 | Müller | B66B 5/0093 |

FOREIGN PATENT DOCUMENTS

| | | | |
|---|---|---|---|
| DE | 19849238 | C1 | 3/2000 |
| EP | 0483560 | A1 | 5/1992 |
| WO | 0051929 | A1 | 9/2000 |
| WO | 2017008849 | A1 | 1/2017 |

* cited by examiner

5 CAR
7 COUNTERWEIGHT
11 PRIME MOVER
12 BRAKE
13 CONTROL UNIT
23 SAFETY MONITORING SWITCH ARRANGEMENTS
25 DOOR SWITCH
27 LADDER PRESENCE SWITCH
31 TAPE READER
39 SAFETY MONITORING DEVICE
43 MAIN RELAY ARRANGEMENT

| K1 | K2 | UET | KNE |
|---|---|---|---|
| 0 | 0 | open | open |
| 0 | 1 | open | closed |
| 1 | 0 | open | closed |
| 1 | 1 | closed | closed |

SAFETY MONITORING DEVICE FOR MONITORING SAFETY-RELATED STATES IN A PASSENGER CONVEYOR SYSTEM AND METHOD FOR OPERATING SAME

FIELD

The present invention relates to a safety monitoring device for monitoring safety-related states in a passenger conveyor system. The invention further relates to a passenger conveyor system comprising such a safety monitoring device. Moreover, the invention relates to a method for monitoring the working order of such a safety monitoring device.

BACKGROUND

Passenger conveyor systems in the form of elevators, escalators or moving walkways are used to convey passengers within buildings. The passenger conveyor system is permanently installed in the building. In the case of an elevator, an elevator car can be shifted vertically between different floors. In the case of escalators or moving walkways, passengers can be conveyed on step units along inclined or horizontal travel paths while standing.

In order to be able to ensure passenger safety, current safety-related states of a number of components of a passenger conveyor system should be monitored within said system in order then to be able to safely operate or activate other components of the passenger conveyor system in a suitable manner, for example. In order to be able to monitor such safety-related states of components of the passenger conveyor system, sensors and/or switches are usually provided on the corresponding components or at different points of the passenger conveyor system. Signals from such sensors or switches can be made available to a control unit of the passenger conveyor system such that said control unit can take into account the signals when controlling functions of the passenger conveyor system and thus can achieve safe operation of the passenger conveyor system.

Examples of safety means for passenger conveyor systems and their operation are given, inter alia, in DE 19849238, CN 102190216, WO 2000/051929 and WO 2017/008849.

SUMMARY

Details of embodiments of the invention described herein will be explained in the following using the example of a passenger conveyor system in the form of an elevator. However, features of the elevator can be transferred analogously to other passenger conveyor systems such as escalators or moving walkways.

In an elevator, a so-called safety monitoring chain is conventionally used to ensure safe operation of the elevator. The safety monitoring chain comprises a plurality of sensors and/or switches, using which information about current safety-related states of components of the elevator can be determined.

For example, a door switch is typically provided on a car door and on each of a plurality of shaft doors, which switch is closed as long as the relevant door is closed. The door switches are connected in series within the safety monitoring chain such that the safety monitoring chain as a whole is closed only when each of the door switches is closed. An elevator control unit connected to the safety monitoring chain may or can in this case shift an elevator car within an elevator shaft only if the safety monitoring chain as a whole is closed and it may therefore be assumed that all the car and shaft doors are currently closed.

The safety monitoring chain can additionally comprise further switches and/or sensors. For example, what is referred to as a car emergency limit switch (KNE switch) can be provided in the elevator, which switch is normally closed and which is actuated so as to open as soon as the elevator car is shifted beyond a permissible movement path, for example toward an elevator shaft ceiling or toward an elevator shaft floor. Alternatively, a sensor system can be provided, which enables the functionality of the KNE switch by it being possible to determine, using the sensor system, a current position of the elevator car within the elevator shaft and it being possible to detect if the elevator car is moved beyond the permissible movement path and which then causes the safety monitoring chain to be interrupted. This can ensure that the safety monitoring chain is interrupted as soon as the elevator car leaves its permissible movement path.

Furthermore, as an exception to a rule according to which the elevator car may never be moved as long as the car door or one of the shaft doors is open, provisions can be in place in an elevator which, in predefined exceptional situations, make it possible to open such doors while the elevator car is not stationary or to move the elevator car even though at least one door is open. For example, it can be desired that doors already begin to open just before the elevator car reaches and stops at a target position in order thus to be able to accelerate door opening processes and reduce stop lengths at the target position. For this purpose, for example, a switchable connection can be provided in parallel with the series-connected door switches, which connection can be closed at times to temporarily bypass the doors (UET switch) in order to be able to open doors without interrupting the safety monitoring chain. The UET switch can be closed, for example, and thus the region of the safety monitoring chain comprising the door switches can be bypassed as soon as it is detected, for example using a sensor system, that the elevator car is sufficiently close to a desired target position, i.e. less than 20 cm or less than 10 cm away from said position.

A safety-related state can be detected directly with the aid of a switch and this switch can be integrated into the safety monitoring chain.

Alternatively, the safety-related state can be monitored, for example using a sensor system. In this case, the sensor system can evaluate signals representing the safety-related state using a controller arrangement, in order then to be able to suitably actuate a switch integrated in the safety monitoring chain. For such an implementation, in particular relays can be used as switches integrated into the safety monitoring chain, which relays can be switched in a desired manner by means of control voltages suitably generated by the controller arrangement.

In order to be able to ensure sufficient safety, usually both the controller arrangement and a relay arrangement is redundant. For example, the relay arrangement comprises two series-connected relays, both of which must be brought into a closed state by the controller arrangement in order, overall, to close an associated switching state within the safety monitoring chain.

Effort for implementing a safety monitoring device can be considerable, in particular due to a large number of components to be supplied and the interconnection of said components.

Inter alia, there can be a need for a safety monitoring device in which such an effort is reduced. Furthermore, there can be a need for a passenger conveyor system equipped with such a safety monitoring device. In addition, there can be a need for a method using which the working order of such a safety monitoring device can be monitored.

According to a first aspect of the invention, a safety monitoring device for monitoring safety-related states in a passenger conveyor system is proposed. The safety monitoring device has a first and a second double contact relay as well as a first and a second controller. Both double contact relays are configured, in each case in a manner controlled by a control voltage, to switch a first normally open contact and a second normally open contact as well as a feedback contact synchronously with one another between an open and a closed relay state. The two controllers are each configured to determine properties of the passenger conveyor system correlated with a safety-related state and to generate the control voltages for the first or the second double contact relay depending on the determined properties. In this case, a first and a second safety monitoring switch arrangement are formed by means of the two double contact relays and the two controllers. The first safety monitoring switch arrangement is configured to monitor a first safety-related state and to correspondingly switch a first switching state within a safety monitoring chain of the passenger conveyor system. The second safety monitoring switch arrangement is configured to monitor a second safety-related state and to correspondingly switch a second switching state within the safety monitoring chain of the passenger conveyor system. In this case, the first safety monitoring switch arrangement comprises the first normally open contact of the first double contact relay and, connected in series therewith, the first normally open contact of the second double contact relay. The second safety monitoring switch arrangement comprises the second normally open contact of the first double contact relay and, connected in parallel therewith, the second normally open contact of the second double contact relay.

According to a second aspect of the invention, a passenger conveyor system is proposed which has a safety monitoring device according to an embodiment of the first aspect of the invention.

According to a third aspect of the invention, a method for monitoring the working order of a safety monitoring device according to an embodiment of the first aspect of the invention is proposed. The method comprises at least the following steps: (a) varying the control voltages generated by the first and the second controller such that one of the first and the second double contact relay is alternately switched briefly to its open relay state and back to its closed relay state, and such that always at least one of the first and the second double contact relay is in its closed relay state; and (b) monitoring whether the feedback contacts of the two double contact relays always indicate a relay state indicating the currently activated relay state.

Possible features and advantages of embodiments of the various aspects of the invention can be considered, inter alia and without limiting the invention, as being based on the concepts and findings described below.

As already noted by way of introduction, in conventional safety monitoring devices for passenger conveyor systems, safety monitoring switch arrangements are used in part to monitor a safety-related state within the passenger conveyor system, a safety monitoring device having controllers for determining properties within the passenger conveyor system correlated with the state to be monitored and relays for opening or closing a contact within a safety monitoring chain.

A safety monitoring switch arrangement having one or more dedicated controllers and relays is conventionally provided for each safety-related state to be monitored. To monitor particularly safety-critical states, two relays are redundantly interconnected in series. Accordingly, at least one controller and one relay, but in many cases two controllers and two relays, have to be provided for each safety-related state to be monitored.

As a result, the number of relays to be supplied in the passenger conveyor system can become large, which can involve significant provisioning and maintenance effort and corresponding costs.

In order to be able to reduce such effort and costs, using double contact relays in a safety monitoring device instead of simple relays, interconnecting said double contact relays in an advantageous manner, and allowing said double contact relays to be activated by two controllers is proposed.

As in simple relays, a control voltage applied to the relay in a control circuit can be used to open or close the relay like a switch in a controlled manner. For example, the control voltage can induce a current through a coil, as a result of which the coil produces a magnetic field which attracts or repels an armature. The armature moved in this way can then move arms of a normally open contact toward or away from one another. In a simple relay only a single normally open contact is opened or closed.

In a double contact relay, however, two normally open contacts simultaneously, i.e. synchronously with one another, moved by one and the same armature, are opened and closed. The double contact relay can thus not only open or close one switch in an operating circuit but two switches in two different operating circuits, in a manner controlled by the control voltage, so as to be synchronized with one other.

Effort in terms of design and thus associated costs are only slightly higher in a double contact relay than in a simple relay and are generally significantly lower than the corresponding effort and costs for two separate simple relays.

As in a simple relay, what is referred to as a feedback contact can additionally be provided in a double contact relay, which feedback contact is moved synchronously with the two normally open contacts. The feedback contact can be used, for example, to check whether the normally open contacts have actually been opened following the applied control voltage. Accordingly, by monitoring the feedback contact, for example, it can be detected if the double contact relay has a fault and no longer switches correctly. In particular, it can be detected if adjacent arms of a normally open contact, for example, are unintentionally welded together or stick together and thus no longer open correctly despite appropriately applied control voltage.

In the safety monitoring device proposed here, the two double contact relays provided therein can advantageously be interconnected such that they form two safety monitoring switch arrangements, using which two different safety-related states can be monitored and associated switching states within the safety monitoring chain of the passenger conveyor system can be switched accordingly. In contrast to conventional safety monitoring devices, desired redundancy can be achieved when switching the switching states without having to provide at least two dedicated relays for each switching state to be switched. Instead, the two double contact relays can be integrated into the safety monitoring chain of the passenger conveyor system, i.e. be interconnected with other components of the safety monitoring chain, such that all desired switching states within the safety monitoring chain can be switched in response to the two monitored safety-related states by means of the only two double contact relays.

In order to monitor, for example, two different safety-related states and to be able to redundantly switch corresponding switching states within the safety monitoring chain, it is therefore not necessary to use at least four relays as before, but only two double contact relays. Effort in terms of design and costs can hereby be significantly reduced.

To enable such saving of relays, the first normally open contact of the first double contact relay is connected in series with the first normally open contact of the second double contact relay to form the first safety monitoring switch arrangement. To form the second safety monitoring switch arrangement, the second normally open contact of the first double contact relay and the second normally open contact of the second double contact relay are interconnected in parallel with one another.

By suitably activating each of the two double contact relays, different switching states can be produced in a desired manner in the two safety monitoring switch arrangements by such an interconnection. For example, the first safety monitoring switch arrangement is only completely closed when both series-connected first normally open contacts of the two double contact relays are closed, i.e. when both controllers activate the two double contact relays to close. In contrast, the second safety monitoring switch arrangement is already closed when only one of the second normally open contacts connected in parallel with one another is closed, i.e. when at least one of the double contact relays is activated by one of the controllers to close, and only open when both second normally open contacts of the two double contact relays are open.

According to an embodiment, the safety monitoring device is set up to take into account that monitoring the first safety-related state requires a higher safety integrity level than monitoring the second safety-related state.

In other words, the specific circuit proposed herein of the two double contact relays can be advantageously used in particular in a configuration in which two different safety-related states are to be monitored within the passenger conveyor system using the safety monitoring device, which conditions differ significantly in terms of their safety integrity level. The first safety monitoring switch arrangement comprising the two series-interconnected first normally open contacts of the first and the second double contact relay can ensure a higher safety integrity level than the second safety monitoring switch arrangement, in which the two second normally open contacts of both double contact relays are connected in parallel with one another.

A safety integrity level (SIL) is understood to mean a term from the field of functional safety, as described, for example, in international standard IEC 62508/IEC61511. A safety integrity level is used to assess electrical, electronic or programmable electronic systems for their reliability of safety functions. The desired level, for example, results in safety design principles that must be adhered to in order to be able to minimize the risk of malfunctions. In general, according to the international standard, there are four safety integrity levels SIL1 to SIL4, with SIL4 representing the safest level.

In particular, according to an embodiment, the safety monitoring device can be set up to take into account that monitoring the second safety-related state requires a safety integrity level SIL1 and monitoring the first safety-related state requires at least one safety integrity level SIL2.

In other words, the first safety monitoring switch arrangement used for monitoring the first safety-related state can be configured such that it can carry out its monitoring function in accordance with the higher requirements of a safety integrity level SIL2 or even SIL3, whereas the second safety monitoring switch arrangement used for monitoring the second safety-related state can be configured such that it can perform its monitoring function only in accordance with the lower requirements of a safety integrity level SIL1.

According to an embodiment, the first safety-related state can indicate whether parts of the safety monitoring chain which monitor closed states of doors of the passenger conveyor system may be temporarily short-circuited. In this case, by switching the first switching state to closed, the parts of the safety monitoring chain which monitor closed states of doors of the passenger conveyor system are then temporarily short-circuited.

In other words, the first safety-related state monitored by the first safety monitoring switch arrangement can contain information as to whether, for example, there are currently conditions in which the actual closed states of the car door and of the shaft doors may be temporarily ignored and the elevator car may be moved despite the car door or shaft door being open, for example. For example, such a safety-related state can exist if the car is very close (e.g. <20 cm) to a target position, i.e. for example to a floor stop, and the relevant door may already be opened before the target position has actually been reached. This can be detected, for example, by analyzing the current position of the elevator car within the elevator shaft. In this case, the information about the instantaneous position of the car can be interpreted as indicating a safety-related state in which the closing states of the doors of the passenger conveyor system may be temporarily ignored and thus parts of the safety monitoring chain that monitor these closed states may be temporarily short-circuited.

If the above condition has been detected, the first and the second controller can activate the two double contact relays in a suitable manner such that both double contact relays enter their closed relay state. The two first normally open contacts of the two double contact relays are then closed, resulting overall in a closed state for the series interconnection in the context of the first safety monitoring switch arrangement. In this closed state, the first safety monitoring switch arrangement can close a circuit that is parallel to the part of the safety monitoring chain that monitors the closed states of the doors of the passenger conveyor system, and can thus temporarily short circuit the monitoring of the doors in the form of a UET contact like in a bypass.

According to a further embodiment, the second safety-related state can indicate whether an elevator car has been moved beyond a permissible movement range. In this case, the safety monitoring chain can be interrupted by switching the second switching state to open.

In other words, the second safety-related state monitored by the second safety monitoring switch arrangement can include information about the current position of the elevator car, and therefore it is possible to determine whether the elevator car is currently within its permissible movement range, i.e., for example, between an uppermost permissible end position and a lowermost permissible end position within the elevator shaft, or whether the elevator car has left its permissible travel range due to a malfunction, for example, and has been moved beyond the upper permissible end position or below the lower permissible end position, for example.

If this condition has been detected, the first and the second controller can activate the two double contact relays in a suitable manner such that both double contact relays enter their open relay state. The two second normally open contacts of the two double contact relays are then both open, resulting overall in an open state also for the parallel interconnection in the context of the second safety monitoring switch arrangement. In this open state, the second safety monitoring switch arrangement, for example if said arrangement is interconnected in series with the remainder of the safety monitoring chain of the passenger conveyor system, acts like an open switch and thus temporarily interrupts the safety monitoring chain. As a result, operation of the elevator or in particular further movement of the elevator car beyond a relevant end position is prevented.

According to a further embodiment, the safety monitoring device further comprises a plurality of series-connected third safety monitoring switch arrangements for monitoring third safety-related states.

In other words, in addition to the first and second safety monitoring switch arrangements already discussed, which implement, for example, tasks of a UET switch and a KNE switch, the safety monitoring device can have further safety monitor switch arrangements using which other tasks or functionalities can be implemented.

These third safety monitoring switch arrangements can be, for example, door switches using which closing states of elevator doors, in particular of the car door or one of the shaft doors, can be monitored. The plurality of third safety monitoring switch arrangements can be connected in series such that they can form part of the safety monitoring chain of the passenger conveyor systems. In the mentioned example of implementing the third safety monitoring switch arrangements, in each case as a door switch, a series interconnection ensures that all doors, and thus all door switches, must be closed in order for said part of the safety monitoring chain to be closed as a whole.

In such an embodiment of the safety monitoring device, the first safety monitoring switch arrangement can be interconnected in parallel with the series of third safety monitoring switch arrangements and the second safety monitoring switch arrangement can be interconnected in series with the series of third safety monitoring switch arrangements.

In other words, the first safety monitoring switch arrangement together with its two series-interconnected first normally open contacts of the two double contact relays can be interconnected in parallel with the series circuit of third safety monitoring switch arrangements. As soon as both first normally open contacts are closed in this case, i.e. as soon as the first switching state is closed, the first safety monitoring switch arrangement thus forms a bypass running parallel to the series connection of third safety monitoring switch arrangements and can thus bypass this series circuit in a controlled manner like a UET switch.

The second safety monitoring switch arrangement together with its two parallel-interconnected second normally open contacts of the two double contact relays can be interconnected in series with the series circuit of third safety monitoring switch arrangements. As long as at least one of the double contact relays is closed, the second switching state also remains closed, and therefore the part of the safety chain formed by the third safety monitoring switch arrangements and the second safety switch monitoring arrangement remains closed overall. This part of the safety chain is opened only when both double contact relays are open at the same time and thus also the second switching state is open. The second safety monitoring switch arrangement can thus temporarily interrupt a safety chain in a controlled manner like a KNE switch.

According to an embodiment, the first and the second controller can each be designed as a safety programmable logic controller.

A programmable logic controller (PLC) is an apparatus that can usually be used to control a system or a machine in an open-loop or closed-loop manner. Programmable logic controllers are increasingly replacing conventional hard-wired, connection-programmed control units. Advantageously, a PLC can be digitally programmed and thus adapted to various tasks. In the simplest case, a PLC has inputs, outputs, an operating system and optionally an interface via which a user program can be loaded. The user program can program how the outputs are to be switched depending on the inputs such that the system or machine functions as desired. The operating system can be kept up-to-date, for example in the form of firmware. In addition to its core tasks of open-loop or closed-loop control, a PLC can also carry out further tasks such as visualizing data, assume a design as an interface, for example in the form of a human-machine interface, carry out alarm signaling and/or recording operational messages (data logging).

A safety PLC (SPLC) is a specific implementation of a PLC. A safety PLC has a largely redundant configuration of its components and is usually designed such that the safety PLC is transferred to a predetermined safe state in the event of a failure of a component or a conflict between redundant components.

With regard to the architecture, inputs and outputs, safety PLCs differ significantly from conventional PLCs. For example, a conventional PLC typically has a microprocessor which executes a program, a non-volatile memory for storing the program, a volatile memory (RAM), for example in order to perform calculations, ports for data communication, and I/O terminals in order to detect and control a system or machine. By contrast, a safety PLC generally has at least two of the respective components, which continuously monitor one another or are monitored by what is referred to as a watch dog circuit.

The inputs of a conventional PLC typically do not have means for testing functionality of an input circuit. In contrast, safety PLCs usually have an internal output circuit which is associated with each input and using which the relevant input can be tested.

Similarly, conventional PLCs typically have only one output switching means, whereas safety PLCs generally have one test point behind each of two safety switches which are arranged behind an output driver, and a third test point downstream of the output driver. Each of two safety switches is generally controlled by a single microprocessor. If an error is detected in one of the two safety switches, for example due to an error in the switch or microprocessor or at the test point downstream of the output driver, the operating system of the safety PLC will automatically detect a system error and the safety PLC will be transferred to a predefined state in which a system can be shut down properly, for example.

Due to the design of the two controllers as safety PLCs, said controllers are suitable for being able to be adapted to different elevator types, for example as retrofit apparatuses. The controllers or the safety monitoring device equipped therewith can additionally ensure a high degree of safety for the passenger conveyor systems equipped therewith.

According to an embodiment, the safety monitoring device can be set up to execute or to control a method according to an embodiment of the third aspect of the invention.

For this purpose, for example, the first and second controllers of the safety monitoring device, which are designed as PLCs or safety PLCs, can be programmed in such a way that the control voltages generated by said controllers are varied such that, although at least one of the two double contact relays is always in its closed relay state, one of the two double contact relays is alternately shifted briefly to its open relay state and back to its closed relay state. This involves continuous monitoring as to whether the associated feedback contact of a double contact relay follows the generated control voltage, i.e. whether the feedback contact indicates the relay state that was actually activated by the associated controller, or whether, for example due to a malfunction within the double contact relay, an actual relay state does not correspond to the desired activated relay state.

According to an embodiment of the method, in the event that the feedback contacts of the two double contact relays do not indicate a relay state indicating the currently activated relay state, the two controllers can generate control voltages such that both the first and the second double contact relay are switched to their open relay state.

In other words, in the event that by monitoring the feedback contacts it can be deduced that at least one of the double contact relays does not correctly follow the activation brought about by the relevant controller and thus a fault within the double contact relay can be assumed, a response can be interpreted as meaning that the two controllers activate their associated double contact relay to switch to its open relay state. As a result, the passenger conveyor system can be transferred to a largely safe state even in the event of a fault in the double contact relay of its safety monitoring device.

According to an embodiment, in the proposed method, each of the two controllers monitors the feedback contacts of each of the two double contact relays.

In other words, the first and the second controllers should not only monitor the feedback contacts of their associated, i.e. controlled by the relevant controller, double contact relay, but rather each controller should instead monitor the feedback contact of its associated double contact relay as well as the feedback contact of the other double contact relay. In this way, redundancy can be created, which further increases the safety of the safety monitoring device and in particular drastically increases the likelihood that malfunctions of their double contact relays will be detected correctly.

According to an embodiment, the proposed method is carried out before, during or after each individual journey of the passenger transport system.

In other words, although the method by which the working order of the safety monitoring device is checked can in principle be executed at any time or so as to be triggered by any events, it is considered advantageous to execute the method at least when a journey is performed by the passenger transport system. This can ensure that the working order of the safety monitoring device is checked sufficiently frequently.

It should be noted that some of the possible features and advantages of the invention are described herein with reference to different embodiments of the safety monitoring device and of a method for monitoring the working order thereof. A person skilled in the art will recognize that the features can be suitably combined, adapted or replaced in order to arrive at further embodiments of the invention.

Embodiments of the invention will be described in the following with reference to the accompanying drawings, although neither the drawings nor the description should be construed as limiting the invention.

The figures are merely schematic and not true to scale. Like reference signs designate like or equivalent features in the various figures.

DETAILED DESCRIPTION

Figure 1:
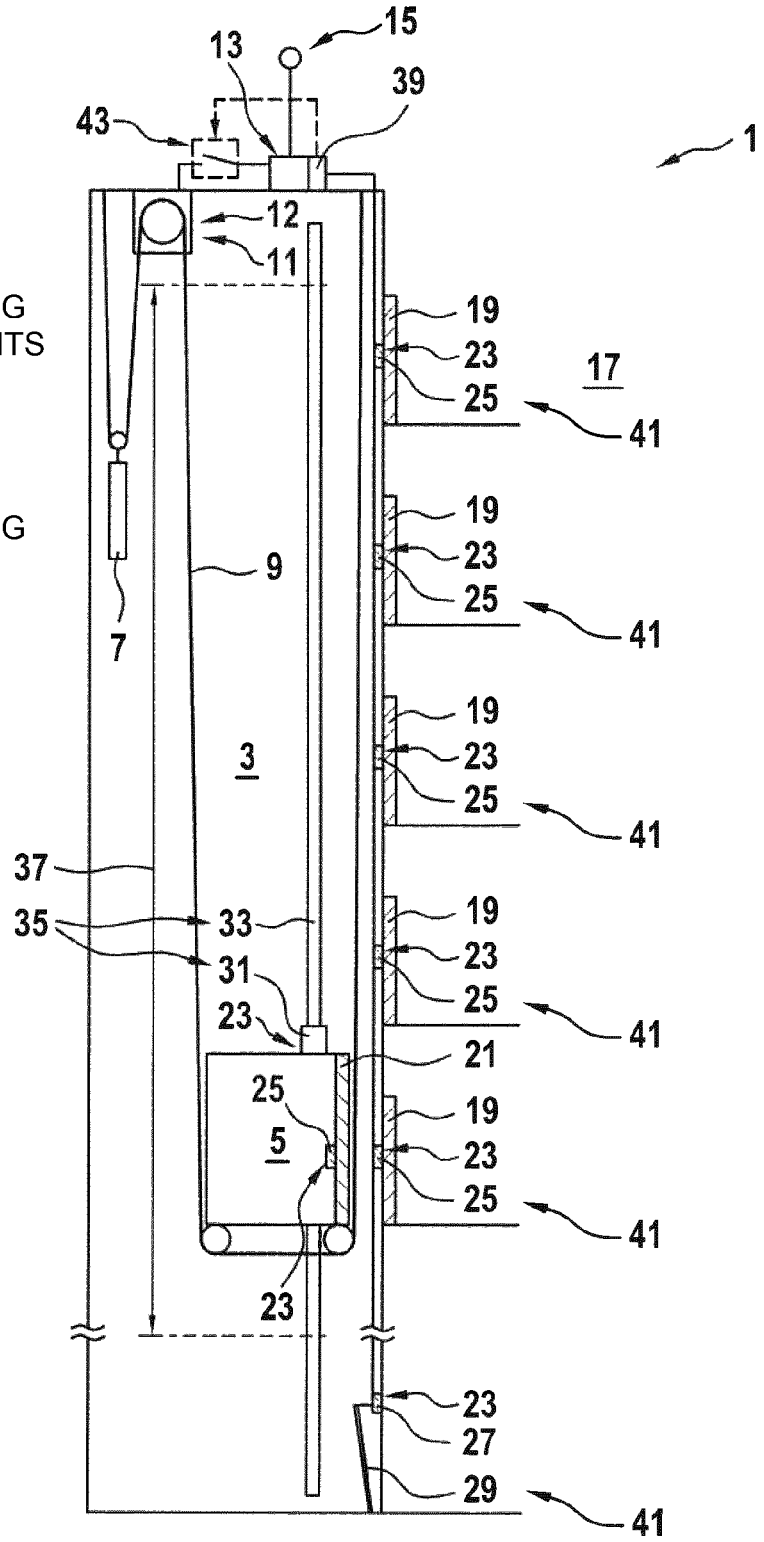
FIG. 1 shows a passenger transport system according to the invention.

FIG. 1 shows a passenger conveyor system 1 in the form of an elevator. The elevator comprises an elevator car 5 and a counterweight 7 which can be shifted vertically within an elevator shaft 3 by means of belts 9 which are driven by a prime mover 11. Furthermore, a brake 12 can be provided for braking the prime mover 11 or for directly braking the elevator car 5. An operation of the prime mover 11 and/or of the brake 12 is controlled by an elevator control unit 13. The elevator control unit 13 can, for example, supply the prime mover 11 with electrical power from an electric power source 15 in a controlled manner.

The elevator car 5 can be moved between different floors 17. A shaft door 19 is provided on each floor 17 and a car door 21 is provided on the elevator car 5.

In the passenger conveyor system 1, a plurality of safety monitoring switch arrangements 23 is provided, using which safety-related states within the passenger conveyor system 1 can be monitored.

For example, door switches 25 are provided on each of the shaft doors 19 and on the car door 21, using which it can be monitored whether the relevant shaft door or car door 19, 21 is currently correctly closed or at least partially open. Furthermore, in a pit region of the elevator shaft 3, a ladder presence switch 27 is provided, using which the presence and correct arrangement of a ladder 29 can be monitored. In the case of both the door switch 25 and the conductor presence switch 27, safety monitoring switch arrangements 23 can be provided, for example as a simple switch to be mechanically actuated.

In addition, the passenger conveyor system 1 can also have more complex safety monitoring switch arrangements 23. Using a magnetic tape 33 extending vertically along the elevator shaft 3 and a magnetic tape reader 31 mounted on the elevator car 5, an absolute position sensor 35 can be formed, for example, using which information about a current position of the elevator car 5 within the elevator shaft 3 can be obtained. Based on this information, safety-related states can then be monitored.

For example, it can be detected whether the elevator car 5 is currently opposite or at least close one of the shaft doors 19 and thus the car door 21 and/or the opposite shaft door 19 may be opened. Furthermore, based on this information, it can be detected whether the elevator car 5 is within a permissible movement range 37 within the elevator shaft 3 or whether it has been unintentionally moved out of this permissible movement range 37.

Data or signals can be transmitted from the various safety monitoring switch arrangements 23 to a safety monitoring device 39, for example by wire or wirelessly.

In particular, a plurality of the safety monitoring switch arrangements 23 can be interconnected, in particular interconnected in series, in order to form parts of a safety monitoring chain 41. For example, the door switches 25 and the ladder presence switch 27 can be connected in series such that the part of the safety monitoring chain 41 formed thereby is closed as a whole only when all the door switches 25 and the ladder presence switch 27 are closed.

The safety monitoring device 39 can communicate with or be part of the elevator control unit 13 and can affect functions of the elevator control unit 13. In particular, the safety monitoring device 39 can actuate one or more main relay arrangements 43 in order, for example, to be able to interrupt a power supply between the elevator control unit 13 and the prime mover 11 and/or to activate or release the brake 12 for braking the elevator car 5.

Figure 2:
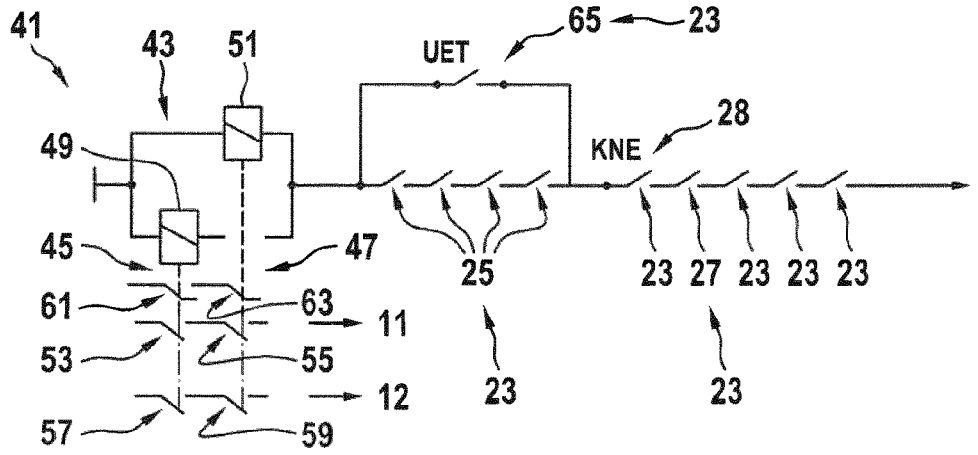
FIG. 2 shows a safety monitoring chain of a passenger transport system according to the invention.

FIG. 2 illustrates details of a safety monitoring chain 41. A plurality of safety monitoring switch arrangements 23 (hereinafter also referred to as "third safety monitoring switch arrangements") in the form of door switches 25 and other safety monitoring switch arrangements 23, for example in the form of a ladder presence switch 27 or the like, are connected in series.

One of these further safety monitoring switch arrangements 23 acts as car emergency limit switch 28 (KNE switch). This car emergency limit switch 28 is opened when the elevator car 5 is moved beyond its permissible movement range 37.

The part of the safety monitoring chain 41 formed by the series-connected safety monitoring switch arrangements 23 is connected in series with the main relay arrangement 43. The main relay arrangement 43 comprises a first main double contact relay 45 having a coil 49, a first normally open contact 53, a second normally open contact 57, a feedback contact 61 and a second main double contact relay 47 comprising a coil 51, a first normally open contact 55, a second normally open contact 59 and a feedback contact 63. The main relay arrangement 43 is normally, i.e. when the coils 49, 51 are not energized, open. Accordingly, the main relay arrangement 43 closes an electrical connection, which extends in series through the first normally open contacts 53, 55 of the first and the second main double contact relay 45, 47, between the power-supplying elevator control unit 13 and the prime mover 11 only when their two coils 49, 51 are energized owing to a fully closed safety monitoring chain 41. Similarly, the brake 12 is energized and thus released only when a connection between a power source and the brake 12 is closed using the main relay arrangement 43 as a result of a fully closed safety monitoring chain 41.

In order to allow the car door 21 and/or one of the shaft doors 19 to be opened under predetermined conditions, although the prime mover 11 shifts the elevator car 5, what is referred to as a UET switch 65 is provided in parallel with the series connection of door switches 25. This UET switch 65 also forms a safety monitoring switch arrangement 23 and may be closed only when the predetermined conditions are met, i.e., for example, when the elevator car 5 has already approached a target floor position to within a few centimeters and already should have started to open the doors 19, 21 before the elevator car 5 has finally stopped at the target floor position. By closing the UET switch 65, the part of the safety monitoring chain 41 formed by the door switches 25 is thus temporarily bypassed.

In order to meet the high safety requirements applicable to passenger conveyor systems 1, both the KNE switch 28 and the UET switch 65 have so far been implemented redundantly, each having two simple relays. For example, in the case of the UET switch 65, the two simple relays were connected in series such that a switching state of the UET switch 65 was closed only when both relays were closed at the same time, i.e., both relays were in their closed relay state.

However, accordingly, four simple relays had to be used overall for the two functions which were to be implemented by the KNE switch 28 and the UET switch 65.

Figure 3:
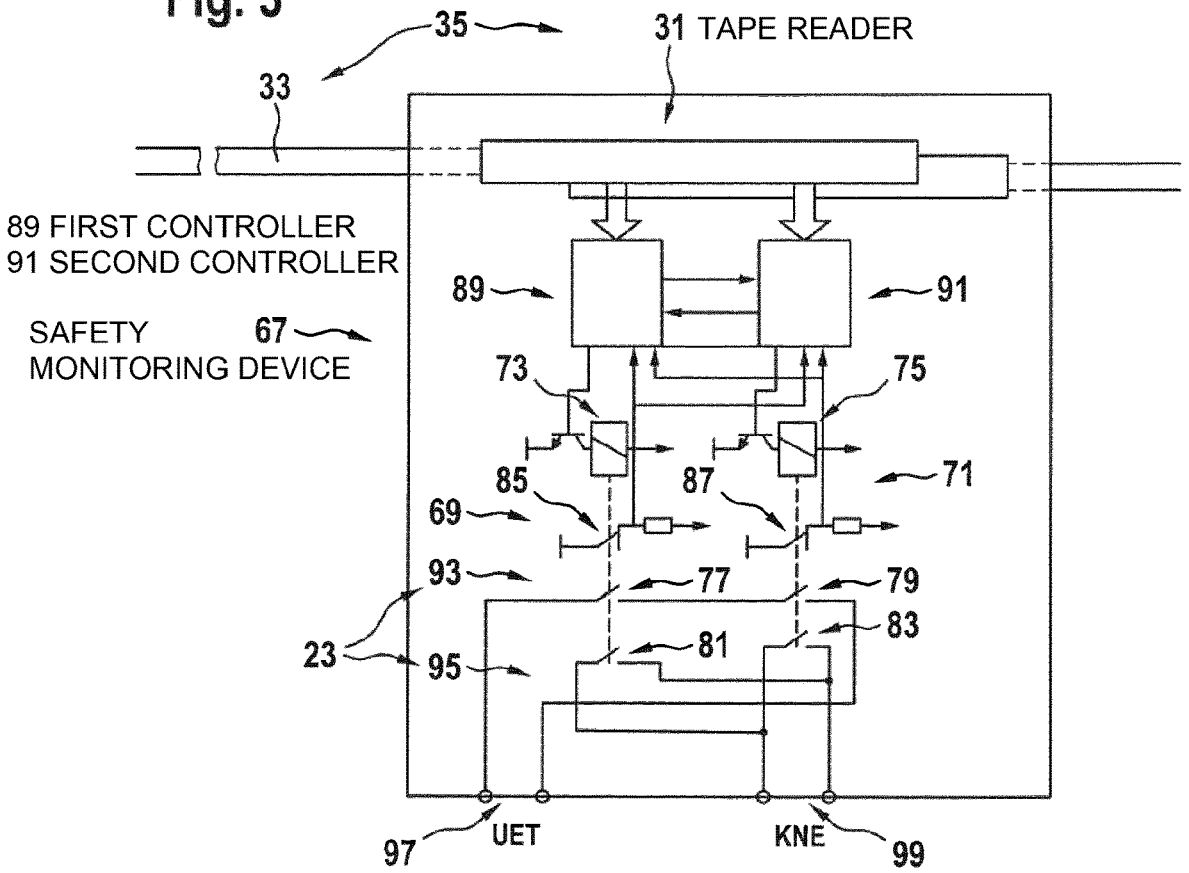
FIG. 3 shows details of a safety monitoring device according to the invention.

FIG. 3 illustrates a safety monitoring device 67 according to the invention, which can be implemented so as to form part of a safety monitoring chain 41 of a passenger conveyor system 1 in order to monitor safety-related states in the passenger conveyor system 1. The safety monitoring device 67 can in particular implement the functions of a KNE switch 28 and a UET switch 65.

The safety monitoring device 67 comprises a first double contact relay 69 and a second double contact relay 71. Both double contact relays 69, 71 are designed as normally opened relays and each have coils 73, 75 which, when supplied with a control voltage, close first normally open contacts 77, 79 and second normally open contacts 81, 83, respectively. Each of the double contact relays 69, 71 also has a feedback contact 85, 87. In each of the double contact relays 69, 71, the relevant coil 73, 75 shifts, i.e. opens and closes, the first and the second normally open contacts 77, 79, 81, 83 of said relays and their feedback contact 85, 87 synchronously with one other and thus can be switched by the control voltage into an open or closed relay state.

The safety monitoring device 67 further comprises a first and a second controller 89, 91. The two controllers 89, 91 are designed to determine properties of the passenger conveyor system 1 which correlate with a safety-related state, and then to generate suitable control voltages for the first or the second double contact relay 69, 71 depending on the determined properties. The two controllers 89, 91 can communicate with one another or control one another. In particular, the controllers 89, 91 can be in the form of safety programmable logic controllers (SPLC).

In the shown example, the two controllers 89, 91 receive information about the current position of the elevator car 5 within the elevator shaft 3 from the absolute position sensor 35. From this information, the controllers 89, 91 can derive whether the elevator car 5 is currently within the permissible movement range 37 or whether it has left said range. Depending on which of these two cases applies, the controllers 89, 91 can produce different control voltages for the two double contact relays 69, 71 in order to emulate the function of a KNE switch 28 by means of the safety monitoring device 67. In addition, from the information the controllers 89, 91 can infer whether the elevator car 5 is currently sufficiently close to a target floor position such that it appears permissible to temporarily bypass the part of the safety monitoring chain 41 formed by the door switches 25 in order to emulate the function of a UET switch 65 by means of the safety monitoring device 67.

The safety monitoring device 67 forms, together with its double contact relays 69, 71 and its controllers 89, 91, safety monitoring switch arrangements 23 in the form of a first and a second safety monitoring switch arrangement 93, 95.

The first safety monitoring switch arrangement 93 comprises the first normally open contact 77 of the first double contact relay 69 and the first normally open contact 79 of the second double contact relay 71, which contacts are interconnected in series. By means of this first safety monitoring switch arrangement 93, the safety monitoring devices 67 emulate the function of the UET switch at a first output 97.

The second safety monitoring switch arrangement 95 comprises the second normally open contact 81 of the first double contact relay 69 and the second normally open contact 83 of the second double contact relay 71, which contacts are interconnected in parallel with one another. By means of this second safety monitoring switch arrangement 95, the safety monitoring devices 67 emulate the function of the KNE switch at a second output 99.

An actually assumed relay state of each of the double contact relays 69, 71 can be determined by the controllers 89, 91 via the relevant feedback contact 85, 87 of the associated double contact relay 69, 71. As a result, it can be monitored whether a relay state, activated by a controller 89, 91, in the associated double contact relay 69, 71 has led to the desired relay state being assumed or whether a fault has prevented this. Each of the two feedback contacts 85, 87 can transmit a feedback signal to each of the two controllers 89, 91.

Figures 4A, 4B:
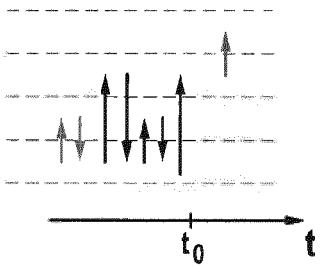
FIG. 4*a* shows activated relay states and resulting switching states in the safety monitoring device according to the invention.
FIG. 4*b* illustrates a variation of activated relay states as part of a method according to the invention for monitoring the working order of a safety monitoring device.

FIG. 4*a* illustrates, in table form, possible control voltages K1, K2 produced by the two controllers 89, 91 for controlling the first and the second double contact relay 69, 71 into an open relay state (K1="0" or K2="0," i.e. no control voltage applied to the coil) or a closed relay state (K1="1" or K2="1," i.e. control voltage applied to the coil) and resulting switching states UET, KNE at the two outputs 97, 99 of the safety monitoring device 67. In this case, the first output 97 is designed to implement the function of the UET switch 65 and the second output 99 is designed to implement the function of the KNE switch 28.

It can be seen that the UET switching state emulated by the first safety monitoring switch arrangement 93 is closed only when both double contact relays 69, 71 have been activated by the two controllers 89, 91 into their closed relay state ("1"). In addition, the KNE switching state emulated by the second safety monitoring switch arrangement 95 is then open only when both double contact relays 69, 71 have been activated by the two controllers 89, 91 into their open relay state ("0").

Using the safety monitoring device 67 described, the function of the UET switch 65 can be implemented via the first safety monitoring switch arrangement 93 at a very high safety integrity level of SIL2 or even SIL3 required for this purpose. The function of the KNE switch 28 can be implemented via the second safety monitoring switch arrangement 95 at least at the safety integrity level of SIL1 that is sufficient for this purpose.

Finally, an embodiment of a method is explained with reference to FIG. 4*b*, using which method the working order of the safety monitoring device 67 can be monitored.

At predetermined time intervals, i.e., for example, periodically, or triggered by particular events such as the beginning or the end of a journey, the normal operation of the safety monitoring devices 67, in which the safety-related states are monitored in the passenger conveyor system 1, is briefly interrupted. Instead, the control voltages generated by the first and the second controller 89, 91 are varied such that one of the two double contact relays 69, 71 is alternately switched briefly into its open relay state (Kx="0") and back into its closed relay state (Kx="1"), and such that always at least one of the two double contact relays 69, 71 is in its closed relay state.

By such a variation of the control voltages, each of the two double contact relays 69, 71 can be activated at least once to open and subsequently close. Although the first safety monitoring switch arrangement 93 bringing about the UET function is briefly opened and closed again, it is also ensured that the second safety monitoring switch arrangement 95 bringing about the KNE function always remains closed. Thus, the entire safety monitoring chain 41 is always closed during this variation of the control voltages.

While the described method is carried out, it is not only possible to vary the control voltages using, for example, the controllers 89, 91, but also to monitor which actual relay state the feedback contacts 85, 87 of both double contact relays 69, 71 indicate. As long as the double contact relays 69, 71 are functioning properly, the relay state fed back by the feedback contacts 85, 87 should match the relay state activated by the controllers 89, 91. If this is no longer true at a time $t_0$, a fault in one of the double contact relays 69, 71 can be assumed. This can be brought about for example by arms of one of the normally open contacts 77, 79, 81, 83 having been glued or welded together.

In this case, both controllers 89, 91 can generate control voltages such that both the first and the second double contact relays 69, 71 are switched into their open relay state. This can ensure that at least the extremely safety-critical UET function of the first safety monitoring switch arrangement 93 is reliably switched into its open state such that a dangerous movement of the elevator car 5 when the doors 19, 21 are open is avoided at all costs.

The safety monitoring device 67 described herein and the method for monitoring the working order thereof make it possible to reduce the cost of the correspondingly equipped passenger conveyor system 1, since only two double contact relays instead of the conventional four simple relays are needed for their implementation. Furthermore, a higher overall reliability can be achieved because only two instead of the previous four safe relays are needed. Complexity of an electronic circuit for the safety monitoring device 67 can also be simpler than for conventional devices, since fewer components need to be controlled.

Finally, it should be noted that terms such as "having," "comprising," etc. do not preclude other elements or steps and terms such as "a" or "an" do not preclude a plurality. Furthermore, it should be noted that features or steps that have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 passenger conveyor system
3 elevator shaft
5 elevator car
7 counterweight
9 belt
11 prime mover
12 brake
13 elevator control unit

15 power source
17 floor
19 shaft door
21 car door
23 safety monitoring switch arrangements
25 door switch
27 ladder presence switch
28 car emergency limit switch (KNE switch)
29 ladder
31 magnetic tape reader
33 magnetic tape
35 absolute position sensor
37 permissible movement range
39 safety monitoring device
41 safety monitoring chain
43 main relay arrangement
45 first main double contact relay
47 second main double contact relay
49 coil of the first main double contact relay
51 coil of the second main double contact relay
53 first normally open contact of the first main double contact relay
55 first normally open contact of the second main double contact relay
57 second normally open contact of the first main double contact relay
59 second normally open contact of the second main double contact relay
61 feedback contact of the first main double contact relay
63 feedback contact of the second main double contact relay
65 door bypass switch (UET switch)
67 safety monitoring device
69 first double contact relay
71 second double contact relay
73 coil of the first double contact relay
75 coil of the second double contact relay
77 first normally open contact of the first double contact relay
79 first normally open contact of the second double contact relay
81 second normally open contact of the first double contact relay
83 second normally open contact of the second double contact relay
85 feedback contact of the first double contact relay
87 feedback contact of the second double contact relay
89 first controller
91 second controller
93 first safety monitoring switch arrangement
95 second safety monitoring switch arrangement
97 first output for UET function
99 second output for KNE function

The invention claimed is:

1. A safety monitoring device for monitoring safety-related states in a passenger conveyor system comprising:

a first double contact relay and a second double contact relay, each of the first and second double contact relays being controlled by a control voltage to switch a first normally open contact, a second normally open contact and a feedback contact synchronously between an open relay state and a closed relay state;

a first controller and a second controller, each of the controllers determining properties of the passenger conveyor system correlated with a safety-related state of at least one component of the passenger conveyor system and generating the control voltages for controlling the first and the second double contact relays depending on the determined properties;

wherein a first safety monitoring switch arrangement for monitoring a first safety-related state and for correspondingly switching a first switching state within a safety monitoring chain of the passenger conveyor system and a second safety monitoring switch arrangement for monitoring a second safety-related state and for correspondingly switching a second switching state within the safety monitoring chain of the passenger conveyor system are formed by the first and second double contact relays and the first and second controllers;

wherein the first safety monitoring switch arrangement includes the first normally open contact of the first double contact relay connected in series with the first normally open contact of the second double contact relay; and wherein the second safety monitoring switch arrangement includes the second normally open contact of the first double contact relay connected in parallel with the second normally open contact of the second double contact relay.

2. The safety monitoring device according to claim 1 including monitoring the first safety-related state at a higher safety integrity level than monitoring the second safety-related state.

3. The safety monitoring device according to claim 2 including monitoring the second safety-related state at a safety integrity level SIL1 and monitoring the first safety-related state at least at a safety integrity level SIL2.

4. The safety monitoring device according to claim 1 wherein the first safety-related state indicates whether parts of the safety monitoring chain that monitor closed states of doors of the passenger conveyor system may be temporarily short-circuited whereby the parts of the safety monitoring chain that monitor closed states of doors of the passenger conveyor system are temporarily short-circuited by switching the first switching state to closed.

5. The safety monitoring device according to claim 1 wherein the second safety-related state indicates whether an elevator car has been moved beyond a permissible movement range whereby the safety monitoring chain is interrupted by switching the second switching state to open.

6. The safety monitoring device according to claim 1 including a plurality of series-connected third safety monitoring switch arrangements for monitoring third safety-related states.

7. The safety monitoring device according to claim 6 wherein the first safety monitoring switch arrangement is interconnected in parallel with the series-connected third safety monitoring switch arrangements and wherein the second safety monitoring switch arrangement is interconnected in series with the series-connected third safety monitoring switch arrangements.

8. The safety monitoring device according to claim 1 wherein the first and the second controllers are each a safety programmable logic controller.

9. A passenger conveyor system comprising the safety monitoring device according to claim 1 connected to a safety monitoring chain including a plurality of safety monitoring switch arrangements monitoring safety-related states within the passenger conveyor system.

10. A method for monitoring a working order of the safety monitoring device according to claim 1, the method comprising the steps of:

varying the control voltages generated by the first and the second controllers such that one of the first and second double contact relays is alternately switched briefly to the open relay state and back to the closed relay state, and such that at least one of the first and second double contact relays is in the closed relay state at all times; and monitoring whether the feedback contacts of the first and second double contact relays indicate a relay state matching a currently activated relay state of the first and second double contact relays.

11. The method according to claim 10 wherein when the feedback contacts do not indicate the relay state matching the currently activated relay state, the first and second controllers generate the control voltages that switch the first and second double contact relays to the open relay state.

12. The method according to claim 10 wherein each of the first and second controllers monitors the feedback contacts of each of the first and second double contact relays.

13. The method according to claim 10 including performing the steps at least before, during and after each individual journey of the passenger transport system.

14. A passenger conveyor system including the safety monitoring device according to claim 1 comprising:

an elevator shaft having a plurality of shaft doors;

an elevator car having a car door and being movable in the elevator shaft to the shaft doors;

a safety monitoring chain including a plurality of safety monitoring switch arrangements monitoring safety-related states of the car door and the shaft doors; and the safety monitoring device connected to the safety monitoring chain and monitoring the safety-related states of the car door and the shaft doors.

* * * * *